United States Patent [19]

Groshens

[11] Patent Number: 4,906,492

[45] Date of Patent: Mar. 6, 1990

[54] PROCESS FOR THE PRODUCTION OF A HEAT-SEALABLE TEXTILE PRODUCT FOR USE IN GARMENTS

[75] Inventor: Pierre Groshens, Peronne, France

[73] Assignee: Lainiere De Picardie Societe anonyme, Peronne, France

[21] Appl. No.: 903,523

[22] Filed: Sep. 4, 1986

[30] Foreign Application Priority Data

Sep. 4, 1985 [FR] France ..... 85 13143

[51] Int. Cl.[4] ..... B41M 3/12

[52] U.S. Cl. ..... 427/148; 427/152; 427/288; 428/196; 428/198; 428/200

[58] Field of Search ..... 427/288, 152, 148; 428/196, 198, 200

[56] References Cited

U.S. PATENT DOCUMENTS

| | | | |
|---|---|---|---|
| 4,076,881 | 2/1978 | Sato | 428/200 |
| 4,333,980 | 6/1982 | Russell | 428/200 |
| 4,450,196 | 5/1984 | Kamat | 428/200 |
| 4,511,615 | 4/1985 | Ohta | 428/198 |

*Primary Examiner*—Marton C. McCamish

*Attorney, Agent, or Firm*—Mason, Fenwick & Lawrence

[57] ABSTRACT

A process for producing a hot-sealer textile product for use in garments, the textile product comprising a textile substrate having first and second outer surfaces, one of said outer surfaces being provided with heat-sealable adhesive selected from the group comprising a copolyamide, a thermoplastic copolyester, a copolyamide and a thermoplastic copolyester, a chemical derivative of a copolyamide, a chemical derivative of a thermoplastic copolyester, or a chemical derivative of a copolyamide and a thermoplastic copolyester, suitable for use in the heat-bonding of textiles.

8 Claims, 1 Drawing Sheet

PROCESS FOR THE PRODUCTION OF A HEAT-SEALABLE TEXTILE PRODUCT FOR USE IN GARMENTS

This invention relates to a process for the production of a heat-sealable textile product for use in garments, a heat-sealable textile product produced by performance of the process, and an installation for performing the process.

It is already known to form hot-sealer spots on a textile substrate by coating the said substrate with a heat-sealable adhesive, using a paste, dispersion, emulsion or solution. If the substrate is a non-woven, coating with a heat-sealable adhesive in paste form is generally satisfactory. In the case of textile substrates, coating with a silk-screen or process printing frame has the disadvantage that the heat-sealable adhesive can penetrate into the thickness of the textile substrate and cause it to harden and adhesion to occur at the rear, something which is incompatible with use in garments.

The article in the journal CIBA-GEIGY RUNDSCHAU, April 1974, pages 36 et seq., describes the coating techniques used in the textile industry and, more particularly, the doctor method and the reversal or transfer method. According to this article, the transfer method is intended more particularly for coating textiles which have some degree of elasticity and which form a support for synthetic leather. This process comprises the following successive steps: firstly, coating a silicone-coated paper or a steel belt—i.e., a support material—with a coating substance. This coating is continuous—the coating material forming a film—and is carried out by the known doctor technique. The textile for coating is then placed on the support material coated with the coating substance and the whole is pressed by means of pressing rollers to effect the transfer. Pressing is followed by drying. The textile thus coated with the coating substance film is separated physically—i.e. removed—from the support material. However, it should be noted that the above-described prior art reversal or transfer technique is characterised by the succession of the following steps: coating by means of a doctor to form a film of coating substance; then pressing for the transfer; finally drying, these three phases being performed in that order. This known technique as described has several limitations however. The initial coating of the support material by means of a doctor necessarilly results in a continuous film of coating substance, and this is not appropriate for some applications, such as reinforcements for garments, in which the coating substance must be distributed in the form of dispersed spots. The transfer is effected before drying, so that the textile is also heated, thus excluding the use of heat-sensitive textiles. The transfer is effected by pressing and it is therefore probable that at least some of the coating substance penetrates into the textile. It should also be noted that the above-mentioned journal article indicates the "reverse coating roller" technique as a method intended quite specially for the application of an adhesive product.

German patent No. 2 363 670 describes a process and an installation for printing a textile material with ink. An endless metal transfer belt receives ink from printing rollers. The ink on the transfer belt is then dried. The textile material is then pressed on the transfer belt with the simultaneous action of heat, this combination of pressure and heat resulting in the ink being transferred from the metal belt to the textile material. This method, however, has the same disadvantage as indicated previously, i.e. the textile is heated, thus limiting the range of textiles that can be used. Also, this process is not intended for coating with a heat-sealable adhesive, the characteristics of which are quite different from those of an ink. For example, the use of a metal belt does not allow a hot-sealer substance to be transferred.

French patent No. 2 454 334 describes a process for covering a textile web with a powdered material by direct coating, without the need for an intermediate transfer belt. The powder material is deposited directly on the textile web which has been previously heated and which is also heated subsequently for the material to be fixed and stabilized. After this hot deposit, a roller applies a given pressure to the textile web. This patent mentions the problem of heating the textile web as being critical. According to this patent, this problem is solved by heat transmission by radiation, without contact, the main roller of the installation being cooled. However, with this process, even if there is no direct heating there is at least indirect heating of the textile web during the entire manufacturing cycle.

The French Certificate of Addition No. 2 367 136 describes a process for applying a modifier agent to a non-woven fleece comprising fusible thermoplastic fibres. The non-woven fleece and a sheet coated with the coating agent pass between two heated cylinders which form a nip, one of the cylinders having relief patterns and the other being smooth. This process provides, firstly, bonding of the non-woven and, secondly, transfer of the modifier agent by a single operation and at the place where the rollers are in contact, but nevertheless in separate zones (respectively the relief patterns and the cavities). The modifier agent is not a sealer, that function and the characteristics arising therefrom being excluded. This Certificate of Addition therefore relates to pressing and to heat in order to provide the transfer.

French patent No. 2 318 914 describes a process and an apparatus for applying hot-fusible glue in powder form to a textile surface by direct coating, the textile passing over a initial entry roller where it is heated to 220° C., and then over an engraved roller having cavities, at an intermediate temperature of 35° C., and finally over a final exit roller at a temperature of the order of 100° C. Deposition is effected by application of the textile to the engraved roller by means of the two entry and exit rollers. This process and the apparatus therefore allow the application of a network of glue. This application, however, is carried out by means of the heat to which the textile is subjected. Consequently, the disadvantages mentioned hereinbefore regarding the sensitivity of the textile to heat are also not obviated by that patent. In addition, because of the process used, the glue clearly penetrates into the actual thickness of the textile.

The object of the invention is to provide a hotsealer textile product for use in garments, which has the following two characteristics in combination: firstly, the heat-sealable adhesive remains on the surface of the textile substrate of the product, i.e. it does not penetrate into its thickness; secondly, the textile substrate used can—although this is not essential—be of the type which is very sensitive to heat, without being damaged during the manufacturing process. Also, and preferentially, the heat-sealable adhesive is distributed in the form of spots dispersed over the outer surface of the textile substrate.

The invention therefore firstly proposes a process for the production of a hot-sealer textile product for use in garments and comprising a textile substrate, one of the outer surfaces of which is provided with heat-sealable adhesive, the process being a transfer process comprising first depositing the said heat-sealable adhesive on a transfer support and then transferring the heat-sealable adhesive from the transfer support to the substrate, the process being characterized by the improvements comprising the following successive steps: drops of a pasty dispersion of heat-sealable adhesive are first deposited on the at least partially non-stick transfer support. The drops thus initially deposited on the transfer support are then heated in order to dry the deposited dispersion and melt the heat-sealable adhesive constituting it. The drops thus dried and situated on the transfer support are then brought into contact with the textile substrate without the latter being heated, the heat-sealable adhesive being transferred from the transfer support to the textile substrate in the form of spots but without penetrating to the intrior of the substrate because, firstly, the heat-sealable adhesive adheres more to the textile substrate than to the transfer support and secondly there is only contact between the heat-sealable adhesive and the textile substrate rather than the transfer support being pressed on to the textile substrate.

The invention also proposes an installation for performing said process, comprising first drive means for the textile substrate and second drive means for an at least partially non-stick transfer support and, disposed successively from upstream to downstream, means for depositing drops of a pasty dispersion of heat-sealable adhesive heating means for the drops thus deposited, and transfer means for the drops thus dried from the transfer support to the textile substrate.

Unlike the teaching of the prior art, the textile substrate is not heated during the transfer nor is it heated before or after the transfer, and this means that any type of textile substrate desired can be used. In addition, and again unlike the teaching of the prior art, the transfer is not effected by pressing but solely by contact between the heat-sealable adhesive and the textile substrate, the transfer support remaining separated from the textile substrate during the transfer.

The invention will be more readily understood from the accompanying drawings wherein.

Figure 1:
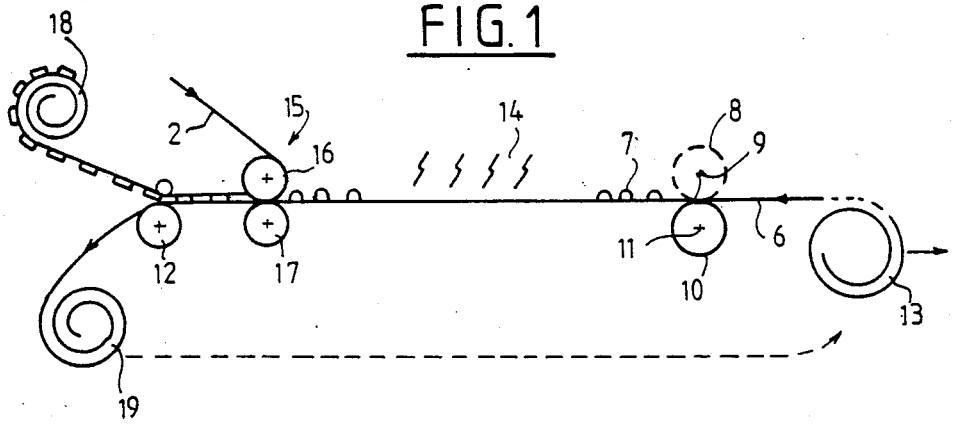
FIG. 1 is a diagram of the apparatus according to the invention.

The invention relates to a process and an installation for the production of a hot-sealer textile product 1 for use in garments, comprising a textile substrate 2 having heat-sealable adhesive on one of its outer surfaces 3.

Preferably, and according to the invention, the heat-sealable adhesive is distributed over the textile substrate 2 at spots 4 which are dispersed over the corresponding outer surface 3. The term "spots" denotes individualized zones, i.e. they are not constrained, as compared with a continuous film, inter alia and more generally of an at least pseudo circular general shape resembling the contour of a drop. Within the meaning of this invention the term "spot" also covers a linear form or a surface form of varying extent, a rectilinear form, and so on, again as compared with a continuous form.

The invention also relates to a hot-sealer textile product 1 of this kind produced by the process or by means of the installation according to the invention.

Also, and in addition to the arrangement of the heat-sealable adhesive in the form of spots, the textile product 1 according to the invention has the characteristics, firstly, that the textile substrate 2 may be of a type which is very sensitive to heat and, secondly the heat-sealable adhesive remains on the surface of the textile substrate 2 without penetrating into the interior, in the thickness of the textile substrate 2, irrespective of the nature of the textile used.

These two characteristics can exist in combination with the spot arrangement.

Depending upon the required application, any textile substrate 2 may be used, e.g. it may be made up of yarns based on natural or synthetic fibres which are not particularly sensitive to heat (polyester, polyamide 6—6, polyethylene) or which are very fragile thermally (polyamide 6, polypropylene, acrylate, "Rhovyl" type PVC (registered trade mark).

Figure 3:
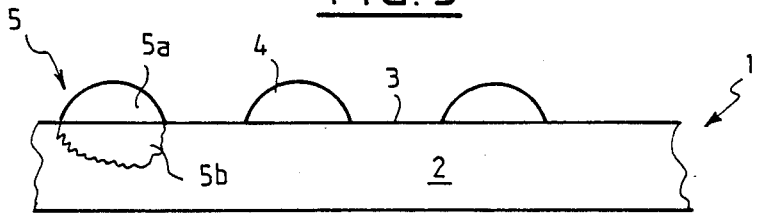
FIG. 3 is a section of the product.

The substrate is generally in the form of a transversely deformable web or fleece which inter alia can be wound on itself or on a cylinder or roller. According to the invention the heat-sealable adhesive is applied to the fleece but does not penetrate to the interior perpendicularly. FIG. 3 shows at 5, for comparison, a spot of heat-sealable adhesive applied to a textile substrate 2 by one of the conventional methods. It will be seen that the spot 5 has an outer part **5*a* disposed on the surface 3 of the substrate and a part 5*b* which has diffused inside the fibres of textile material forming the substrate 2. This part 5*b* makes the textile product less flexible and reduces the useful amount of heat-sealable adhesive formed by the outer part 5*a***.

On the other hand, according to the invention, the spots 4 do not penetrate into the textile substrate 2, i.e. they remain completely raised on the surface 3, and the textile product retains its original flexibility while being effective from the point of view of adhesion, the hot-sealer substance not being "lost" inside the thickness of the textile substrate 2.

The heat-sealable adhesive itself does not directly form part of the invention. It is a copolyamide and/or thermoplastic copolyester and/or chemical derivatives of either or both, alone or in combination with other copolymers which may be thermoplastic, thermo-setting in an aqueous dispersion and/or an alcoholic dispersion and/or some other polar solvent, originally being in paste form at ambient temperature.

The process according to the invention is of the transfer type, i.e. the heat-sealable adhesive is first deposited on a transfer support 6 and then the heat-sealable adhesive is transferred from the transfer support 6 of the substrate 2.

The process according to the invention is characterized by the improvements comprising the following successive steps: drops 7 of a dispersion of heat-sealable adhesive are first deposited on the at least partially non-stick transfer support 6. The drops thus initially deposited on the transfer support 6 are then heated in order to dry the deposited dispersion and melt the heat-sealable adhesive constituting it. The drops thus dried and situated on the transfer support are then brought into contact with the textile substrate 2 without the latter being heated, the heat-sealable adhesive being transferred from the transfer support 6 to the textile substrate 2 in the form of spots but without penetrating to the interior of the substrate 2 because, firstly, the heat-sealable adhesive adheres more to the textile substrate 2 than to the transfer support 6 and secondly there is only contact between the heat-sealable adhesive and the textile substrate 2 rather than the transfer support 6 being pressed on to the textile substrate 2.

It is clear that the expression "drop" relates more particularly to the case of a deposit in the form of a circular spot, but the expression "drop" also covers a substantially linear or surface deposit within the meaning of this invention.

In addition, the transfer support 6 on which the drops 7 of a dispersion of heat-sealable adhesive have been deposited and dried is moved in synchronism and side-by-side with the textile substrate 2 in a transfer zone starting from a convergence zone, said transfer zone being adapted to effect the transfer of the drops.

Hereinafter the term "convergence zone" denotes the zone where the support 6 and the substrate 2 are brought close together, this zone being in the form of a point or at least of limited length. The term "transfer zone" denotes a zone of longer length starting from the convergence zone and extending downstream where the transfer is effectively carried out.

In the transfer zone the transfer support 6 is kept distanced from and in parallel and without direct contact with the textile substrate 2 and the spacing between them is adjusted according to the thickness of the deposited drops in order simultaneously to effect the transfer while avoiding any penetration of the hot-sealer substance into the textile substrate 2.

Finally, the mattness of the spots of heat-sealable adhesive on the textile substrate 2 is adjusted according to the mattness of the transfer support 6. In effect, matt or glossy spots 4 are obtained depending upon the mattness of the support 6. Thus spots 4 of greater or lesser mattness are obtained by adjusting the mattness of the support 6. When the support 6 is glossy the spots 4 are glossy. A non-stick support 6 is glossy when it is smooth and without any roughness. When liquid drops 7 are deposited on such a support, the surface of the solid drops after cooling is smooth. On the other hand, a non-stick support 6 is matt when it has rough portions and these will be found on the outer surfaces of the solid drops after cooling.

The deposit on the transfer support 6 is preferably effected by silk-screen or process printing rather than by means of a doctor, although the deposition technique is not itself the subject of this invention. The transfer support 6 is preferably formed by a mat of glass fabric coated with a non-stick product, more particularly polytetrafluoroethylene or silicone based. The use of such a non-stick transfer support 6 rather than an ordinary metal belt or just of paper as is the case in the prior art is one of the conditions which promotes the transfer of heat-sealable adhesive from the support 6 to the substrate 2 by contact and not by pressing.

The term "transfer by contact" denotes a transfer of the heat-sealable adhesive by means of a transfer support 6 and by contact of said heat-sealable adhesive with the textile substrate 2 but without direct contact between the textile substrate 2 and the transfer support 6. This explains the adjustment of the spacing between the substrate 2 and the support 6, to, at the maximum, the thickness of the deposited and dried drops, as indicated hereinbefore (to within the allowances for the thicknesses of the substrate 2 and the support 6).

In the transfer zone in which transfer takes place, the textile substrate 2 is not heated, i.e. it is at ambient temperature, and incidentally has not been heated previously.

After the transfer, the textile substrate 2 is not heated either, and if necessary the spots 4 of heat-sealable adhesive on the textile substrate 2 (and hence the substrate 2 itself as a result, generally) are cooled in order to solidify them. Such solidification has not yet taken place since the transfer (convergence zone) takes place immediately or shortly after the drying of the drops 7 and the melting of the polymer or polymers making up said drops 7.

If required, mutual forces are applied to the textile substrate 2 and to the transfer support 6, in the convergence or transfer zone, such forces tending to bring the same together. Said mutual forces, however, are limited and their only purpose is to provide satisfactory contact between the textile substrate 2 and the drops 7 only (but not the transfer support 6).

Again possibly and if necessary and/or possible, additional heat is supplied in the convergence zone. Such heat supply is intended to facilitate transfer to the extent necessary. However, firstly, such heat supply cannot replace the previous heat supply in respect of the drops 7 and is not intended for their drying. Also, if such a heat supply is required, it relates rather to the drops 7 (possibly the transfer support 6 as a result) than the textile substrate 2. Generally, such additional heating is required only to keep in a molten state hot-sealer polymers which have a high melting point and a high viscosity in the molten state.

In the foregoing description and in the following description, the same expression "drop" 7 is used to designate the deposit of heat-sealable adhesive throughout the entire cycle of the process. However, apart from the note already made regarding the concept of "drop" it is understood that the actual nature of the drop develops during the process, passing particularly originally from the paste state to finally the dry state.

An installation for performing the process comprises first drive means 15 for the textile substrate 2 and second drive means 12 for an at least partially nonstick transfer support 6 and, disposed successively from upstream to downstream, means 8, 10 for depositing drops of a dispersion of heat-sealable adhesive on support 6, heating means 14 for the drops thus deposited, and transfer means 12, 15, 16, 17 for the drops thus dried from the transfer support to the textile substrate 2.

The drop transfer means comprise the first and second drive means 12, 15 arranged so as to operate in synchronism and calendering rollers or the like 16, 17 which are spaced slightly apart transversely in order also to keep the transfer support 6 and the textile substrate 2 apart and without direct contact with one another, the spacing between them being adjusted in dependence on the thickness of the deposited drops (and the thickness of the substrate 2 and the support 6), inter alia by adjustment means acting on the calendering rollers.

According to the invention, the transfer means 12, 15, 16, 17 have no means for providing direct mutual pressure between the textile substrate 2 and the transfer support 6 in order to effect their intimate contact.

The transfer means 12, 15, 16, 17 provide a transfer zone of a certain length adapted to allow transfer of the drops.

Finally, the transfer zone has no means for heating the textile substrate 2.

The first drive means 15 consist, for example, of one of the calendering rollers 16, 17 belonging to the transfer means, said calendering roller being rotated by drive means such as a motor.

The second drive means 12 comprise, for example, a drive roller disposed downstream of the apparatus, more particularly after the calendering rollers 16, 17 and at the end of the transfer zone.

The means 8, 10 for depositing drops in the pasty state on the non-stick transfer support 6 comprise, for example, a process or silk-screen printing roller 8 with the centre-line 9 and a solid facing companion roller 10, of parallel centre-line 11, the two rollers 8, 10 being in contact on either side of the transfer support 6. These two rollers 8, 10 are disposed essentially upstream of the apparatus and rotate in opposite directions by drive means such as a motor. This motor is associated with the motor for the drive means 12 so that the transfer support 6 moves at the same linear speed both upstream and downstream.

The heating means 14 may form the subject of many various embodiments. They are essentially means for heating the drops 7 by radiation (for example infrared or microwave) or by convection (hot air) rather than conduction, in view of the fact that the transfer support itself is normally a relatively poor or slight conductor of heat.

The heating means 14 are of variable intensity (over their length) and extend over a length (i.e. are operative for a corresponding time allowing for the speed of movement of the transfer support 6) such that the drops 7 deposited by the rollers 8, 10 are successively dried and then the polymer making up the heat-sealable adhesive is at least partially molten. It should be noted that the heating means 14 are normally disposed over a linear path of the transfer support 6 between the deposition rollers 8, 10 and the calendering rollers 16, 17. This arrangement enables the heating means 14 to be distributed over the required path length without affecting the configuration of the apparatus, a feature which would not be the case if the heating means were incorporated in a roller, in which case the path lengths would be fixed and limited.

The heating means 14 are disposed downstream, generally near the deposition rollers 8, 10, to avoid an excessively bulky installation. Generally, they are disposed upstream of the calendering rollers 16, 17, sufficiently near them for the heat-sealable adhesive still to be molten in the convergence zone while being arranged not to provide excessive heating of the textile substrate 2 arriving on the calendering roller 16.

The calendering rollers 16, 17 define the convergence zone. These two cylinders are more particularly identical, have the same radius, are smooth, have parallel centrelines, and are driven in opposite directions in synchronism. They are slightly spaced transversely from one another, i.e. they are not tangential to one another, of course, but their facing nearer outer surfaces are spaced apart and are not in contact, such spacing being adjusted in dependence on the thickness of the drops deposited by the deposition rollers 8, 10. More particularly, this spacing is such that it is equal at maximum to the thickness of the drops, to within the thicknesses of the substrate 2 and of the support 6. To this end, the shafts of the calendering rollers 16, 17 can be supported by two pairs of bearings having adjustable mutual spacing. Adjustment means such as worms or the like enable this spacing to be adjusted. Locking means such as nuts or the like enable this fixed spacing to be maintained. The adjustment means generally comprise means for displaying the value of the spacing.

Reversing or deflecting rollers or the like enable the end of the transfer zone and the beginning of the divergence zone of the textile substrate 2 and the transfer support 6 to be defined. The reversing rollers are so arranged similarly to the calendering rollers 16, 17 as to be spaced comparably to said rollers 16, 17. The calendering rollers 16, 17 and the reversing rollers are axially spaced by a length defining the length of the transfer zone. This length is adjustable, if necessary, the bearings of the calendering and reversing rollers being arranged accordingly. At all events, this length is such that the heat-sealable adhesive has time to recrystallize so that at the end of the transfer zone the drops 7 are integrally transferred from the support 6 to the substrate 2.

If necessary, means for slight mutual pressure are associated with the calendering rollers 16, 17 and the reversing rollers respectively and are intended solely to keep the required spacing between the substrate 2 and the support 6 and hence the quality of the transfer. The light pressure means are therefore intended essentially to ensure that the substrate 2 and the support 6 are properly applied to their respective calendering roller. On the other hand, and as already stated hereinbefore, such pressure means are not intended to provide direct contact with pressure between the calendering or reversing rollers respectively, it being necessary, on the contrary, to avoid such direct contact with pressure.

If required, and to the extent necessary and/or possible, additional heating means may be provided at the upstream limit of the convergence zone for heating the drops 7 essentially. However, such additional heating means cannot replace the heating means 14 and do not have the same function as the heating means 14. Generally, such additional heating means are required only to keep the heat-sealable adhesive in the molten state until the time of transfer. This variant is useful only for heat-sealable adhesive having a high melting point and high viscosity in the molten state.

Downstream of the reversing rollers, i.e. at the end of the apparatus, the textile substrate 2 and the transfer support 6 are spaced apart by means of the deflection roller or the like.

The textile substrate provided with the spots 4 of hot-sealer substance is, for example, wound into the form of a reel 18 downstream of the transfer zone.

If required, the installation may also comprise means adapted to cool the spots 4 of heat-sealable adhesive after they have been transferred to the textile substrate 2, said means being disposed in the transfer zone downstream of the convergence zone. These means generally comprise the non-heated ambient air in which the substrate 2 together with the spots 4 of the heat-sealable adhesive moves In a variant, these means are effective cooling means which operate by producing cold, e.g. cooling plates in which a coolant flows, said plates being in direct contact with the transfer support and being situated opposite the textile substrate 2; or a cooling box in whose walls flows a cooling liquid so as to maintain an atmosphere in the said box such that the assembly comprising the textile support 2, the spots of heat-sealable adhesive 7 and the non-stick support 6 are at low temperature and protected from any accidental condensation moisture. Generally, these means are disposed upstream of the reel 18 so that the textile 1 is not reeled until the transfer product is perfectly stable.

According to another feature of the invention, the installation does not comprise means for heating the textile substrate 2 prior to the transfer. In particular, the calendering roller 16 on which the textile substrate 2 is disposed is not heated, and according to a variant of the invention can be cooled by a flow of coolant liquid in order to set the molten polymer immediately it comes into contact with the textile 2.

In a first embodiment (FIG. 1), the installation operates intermittently, the transfer support 6 extending between an upstream storage reel 13 disposed upstream of the deposition rollers 8, 10 and a downstream storage reel disposed downstream of the reversing rollers, more particularly in the area of the reel of hot-sealer textile product 19. When the upstream storage reel 13 is empty, it is replaced by the downstream storage reel 19 and the operating cycle can re-start.

Figure 2:
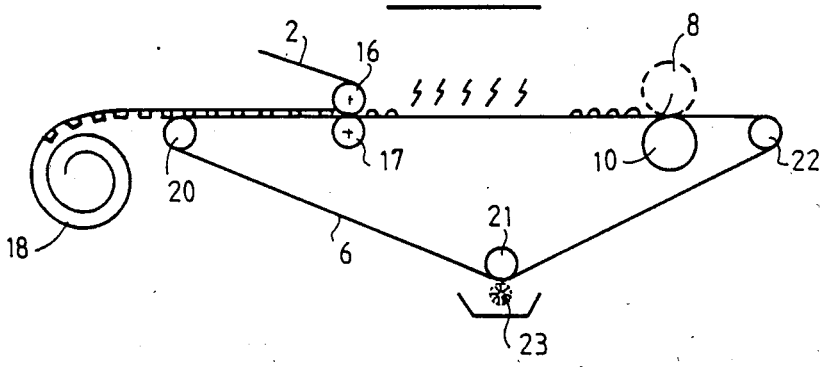
FIG. 2 is a diagram of another embodiment of the apparatus according to the invention.

In a second embodiment (FIG. 2), the installation operates continuously, the transfer support 6 is continuous, endless, being trained for example between three rollers 20, 21, 22 with which the second drive means are associated. More particularly, after passing between the calendar rollers 16, 17 the transfer support 6 passes over a first drive roller 20, a second roller 21 disposed between roller 20 and a third roller 22 upstream of the deposition rollers 8, 10. A brush 23 is disposed beneath the roller 21 for cleaning the surface of the transfer support 6 of any remaining particles of spots or drops.

During operation the transfer support 6 and the textile substrate 2 are trained and driven in synchronism in the main part of the installation, more particularly continuous and at constant speed. In the convergence zone where the substrate 2 and the support 6 face one another they are spaced apart and parallel to one another, only the previously heated drops 7 providing contact between them, the transfer being effected as a result of the fact that there is greater adhesion between the heat-sealable adhesive and the substrate 2 than the non-stick support 6.

I claim:

1. A process for producing a heat-sealable textile product for use in garments, the textile product comprising a textile substrate having first and second outer surfaces, one of said outer surfaces being provided with heat-sealable adhesive selected from the group comprising a copolyamide, a thermoplastic copolyester, a copolyamide and a thermoplastic copolyester, a chemical derivative or a copolyamide, a chemical derivative or a thermoplastic copolyester, or a chemical derivative of a copolyamide and a thermoplastic copolyester, suitable for use in the heat-bonding of textiles, said process comprising the steps of:

(a) depositing drops of a dispersion of the heatsealable adhesive on an at least partially non-stick surface of a transfer support;

(b) following step (a), heating the deposited drops of dispersion to dry the deposited drops and melt the heat-sealable adhesive to form dots on the non-stick surface of the transfer support;

(c) following step (b), bringing the dots into contact with a textile substrate without pressing the transfer support on to the textile substrate and without heating the textile substrate to transfer the heat-sealable adhesive from the transfer support to the textile substrate in the form of spots without substantially penetrating to the interior of the substrate.

2. The process of claim 1, wherein in step (c), the transfer support is moved in synchronism and side-by-side with the textile substrate in a transfer zone where the dots are transferred onto the textile substrate.

3. The process of claim 2, wherein in the convergence zone, the transfer support is kept distanced in parallel and without direct contact with the textile substrate and the distance between them is adjusted according to the thickness of the deposited drops of the dispersion to simultaneously effect the transfer of the dots onto the textile substrate while avoiding penetration of the heat-sealable adhesive into the textile substrate.

4. The process of claim 1, wherein the mattness of the spots of the heat-sealable adhesive on the textile substrate is adjusted according to the mattness of the transfer support.

5. The process of claim 1, wherein prior to the transfer of the dots from the transfer support to the textile substrate in step c), the textile substrate is at ambient temperature.

6. The process of claim 1, wherein in step c), the dots are cooled in a transfer zone where the dots are transferred onto the textile substrate.

7. The process of claim 1, wherein the heat-sealable adhesive is selected from the group comprising a copolyamide, a thermoplastic copolyester, a copolyamide and a thermoplastic copolyester, a chemical derivative of a copolyamide, a chemical derivative of a thermoplastic copolyester, or a chemical derivative of a copolyamide and a thermoplastic copolyester, in combination with other copolymers.

8. The process of claim 1, wherein the heat-sealable adhesive is in paste form at ambient temperature.

* * * * *